United States Patent [19]

Horn

[11] Patent Number: 4,646,975

[45] Date of Patent: Mar. 3, 1987

[54] ELECTROMAGNETICALLY ACTUATABLE FUEL-INJECTION VALVE

[75] Inventor: Martin Horn, Rotenburg, Fed. Rep. of Germany

[73] Assignee: VDO Adolf Schindling AG, Frankfurt am Main, Fed. Rep. of Germany

[21] Appl. No.: 805,084

[22] Filed: Dec. 4, 1985

[30] Foreign Application Priority Data

Dec. 6, 1984 [DE] Fed. Rep. of Germany ..... 3444451

[51] Int. Cl.[4] ..... F02M 63/00

[52] U.S. Cl. ..... 239/585; 239/533.6; 239/533.9; 239/584; 251/337; 29/157.1 R; 29/445

[58] Field of Search ..... 239/585, 533.2–533.12, 239/583, 584; 251/129.15, 129.18, 129.21, 337; 29/157.1 R, 445, 407

[56] References Cited

U.S. PATENT DOCUMENTS 3,107,895 10/1963 Vögeli ..... 29/157.1 R
3,396,449 8/1968 Brantner ..... 29/407 X
3,662,761 5/1972 Hoffman ..... 251/337 X
3,880,605 4/1975 Webster ..... 29/407

*Primary Examiner*—Andres Kashnikow
*Assistant Examiner*—Mary Beth O. Jones
*Attorney, Agent, or Firm*—Martin A. Farber

[57] ABSTRACT

An electromagnetically actuatable fuel-injection valve for injection systems of internal combustion engines having a valve housing, a soft-iron core which is arranged within the valve housing and bears a stationary magnet windind and an armature which is coaxial to the core and faces it forming an air gap therewith. The armature forms a valve closure member. The valve has a passage bore which extends from an inlet, through the soft-iron core, to the valve closure member, within which bore a compression spring is arranged with its one end buttressed therein and its other end resting with a given initial stress against the armature. The compression spring is buttressed via an axially, plastically deformable support element in the passage bore, the resistance to deformation of the buttress element being greater than the force of the given initial stress of the compression spring.

14 Claims, 6 Drawing Figures

ELECTROMAGNETICALLY ACTUATABLE FUEL-INJECTION VALVE

FIELD AND BACKGROUND OF THE INVENTION

The present invention relates to an electromagnetically actuatable fuel-injection valve for injection systems of internal combustion engines, having a valve housing, a soft-iron core which is arranged within the valve housing and carries a stationary magnet winding and an armature which is coaxial to said core and faces it, forming an air gap with it, and is connected to or forms a valve closure member, the core having a passage bore therethrough extending from an inlet to the valve closure member, within which bore a compression spring is arranged with one end buttressed therein, the other end of said spring resting with a given initial stress against the armature.

In such fuel-injection valves it is known to apply the compression spring against a stop screw which can be screwed to a greater or lesser depth into the passage bore, which is developed with a thread. The initial stress of the compression spring applied against the armature is adjustable by this stop screw, which is provided with an axial bore extending through it.

This development is not only expensive to manufacture but also requires a large number of parts. In addition, as a result of the stop screw loosening, the screw and thus also the prestressing force of the compression spring can shift.

The object of the invention is therefore to provide a fuel-injection valve of the introductory-mentioned type which, with only a few simple parts, permits a simple and reliable adjustment of the prestressing force of the compression spring.

SUMMARY OF THE INVENTION

According to the invention the compression spring rests against an axially plastically deformable buttressing element in the passage bore, the resistance to deformation of said buttressing element being greater than the force of the given initial stress of the compression spring. This development with the buttressing element requires only a single part which by axial plastic deformation can be reduced to such a length that the initial stress of the compression spring is imparted the desired value. Once this value has been set it is then retained and cannot change as a result of vibrations during the operation of the fuel-injection valve.

One possibility for buttressing the buttressing element which can be produced without great expense is that the passage bore is a stepped bore which forms an annular shoulder at the transition from the step of larger diameter, which faces the valve closure member, to the step of smaller diameter, the buttressing element being adapted to be buttressed against said annular shoulder.

In order to permit good flow the buttressing element is preferably a sleeve.

This sleeve can have deformation elements which can be buttressed in the passage bore, the deformation elements being formed by a radially extending deformation flange which protrudes at one end of the sleeve. By the axial action of pressure on the sleeve the deformation flange is bent and the cylindrical part of the sleeve is thus displaced axially.

In order that this displacement can take place unimpeded, the radially outer free ends of the deformation elements can be buttressed in the passage bore and their radially inner regions can be freely axially moved. If the sleeve can be acted on in the end region of its cylindrical wall by a deformation force then there is a dependable axial transmission of force into the cylindrical part of the sleeve, which is of stable form, without the region of application of the compression spring being deformed.

In another advantageous embodiment, the deformation elements can be formed by a deformation bellows which is developed coaxial to the sleeve at one end of the sleeve. The transition from the sleeve to the deformation bellows can be developed as a force impact flange which can be acted on by a deformation force. If the deformation bellows has an axially directed cross section which extends from the region of the sleeve to that end of the deformation bellows which is opposite the sleeve then a T-shaped part can be readily introduced from the inlet up into the region of the sleeve and then, after a 90° turn around its longitudinal axis, grip behind the force impact flange. By pulling the T-shaped part the axial plastic deformation of the deformation bellows then takes place until the compression spring has the desired prestressing force. This development has the advantage that adjustment of the prestressing force can be effected on a completely assembled fuel-injection valve under operating conditions and without great expense.

The sleeve preferably is provided at the end thereof which is opposite the deformation elements with a radially extending buttress flange against which the compression spring can rest.

The sole structural part, developed as sleeve, necessary for the adjustment of the initial stress can be produced in simple fashion as a one-piece drawn or extruded part.

BRIEF DESCRIPTION OF THE DRAWINGS

The present invention will be more apparent from the following description made with reference to the accompanying drawings, of which.

DETAILED DESCRIPTION OF THE PREFERRED EMBODIMENTS

Figure 1:
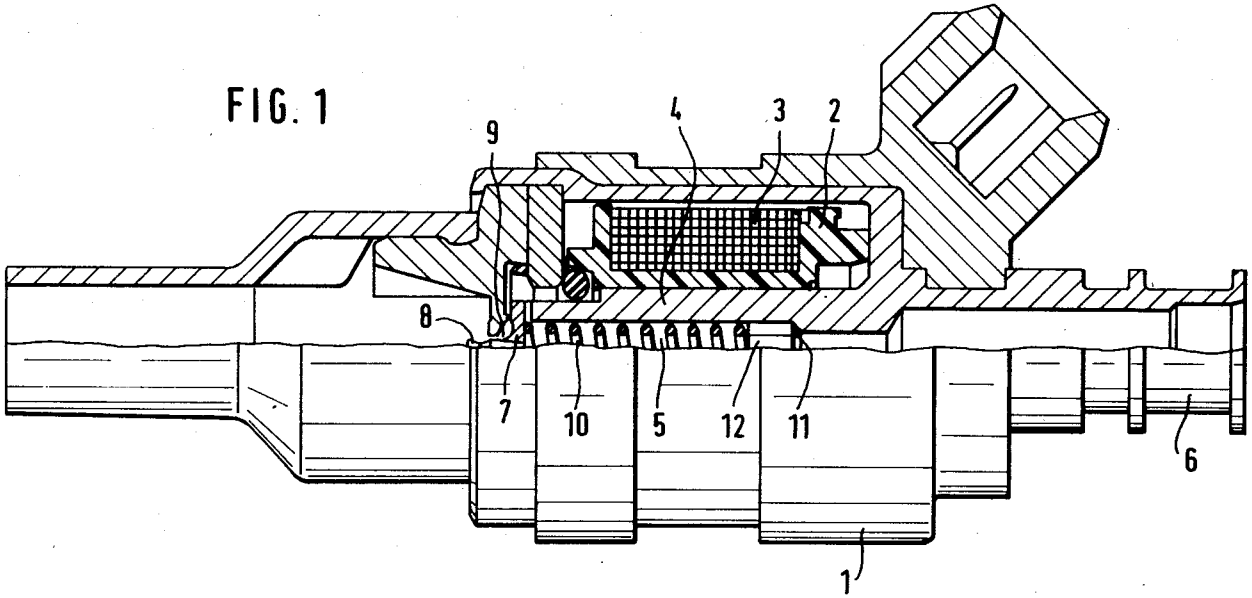
FIG. 1 is a side view of a fuel-injection valve, half in section.

The fuel-injection valve shown has a valve housing 1 within which there is arranged a coil form 2 bearing the magnet winding 3. A soft-iron core 4 provided with a passage bore 5 extends through the coil form, the end thereof which extends out of the valve housing forming an inlet connection 6.

The other end of the soft-iron core 4 is arranged opposite an armature 7 forming an air gap therebetween, the latter being formed as a closure plate and provided on its side facing away from the soft-iron core 4 with a coaxially extending atomization plug 8.

The atomization plug 8 extends into an outlet bore 9.

The armature 7 is urged in its closing direction by a prestressed compression spring 10 which rests against the soft-iron core 4.

The buttressing of the compression spring 10 is effected via a buttress element 12 or 13 (FIGS. 4–6), the end of which opposite the compression spring 10 rests against an annular shoulder 11 of the passage bore 5.

The annular shoulder 11 is formed by a transition from a step of larger diameter, which faces the valve closure member, to a step of smaller diameter of the passage bore 5 which is developed as a stepped bore.

Figure 2:
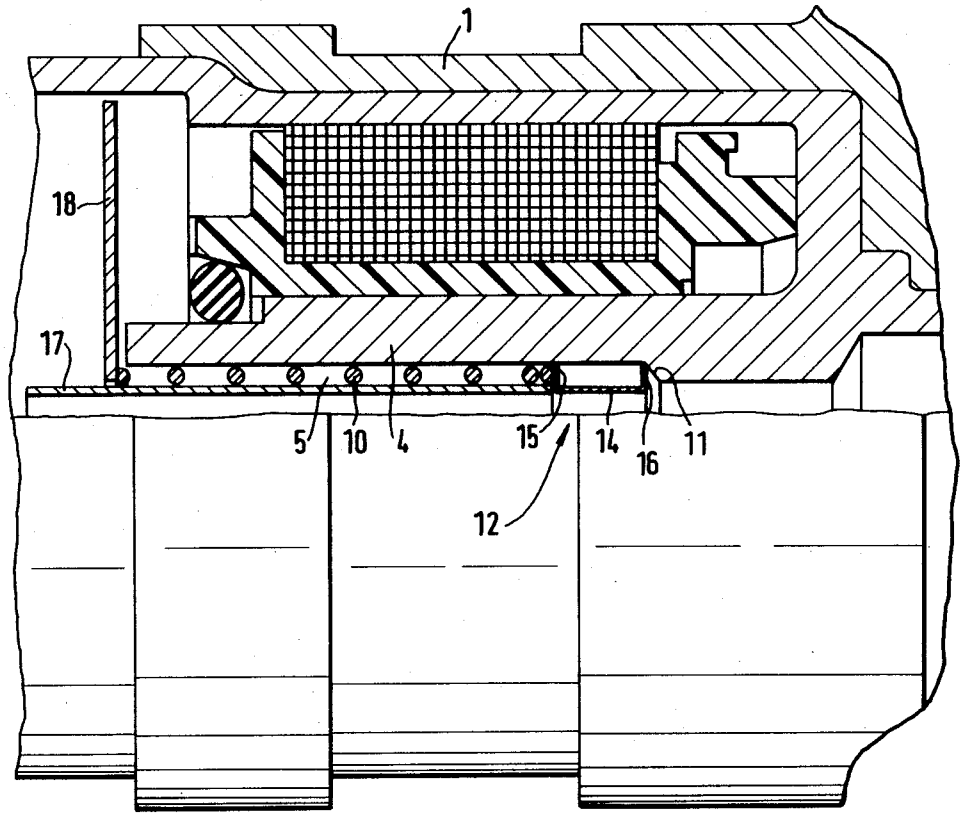
FIG. 2 shows a portion of the valve of FIG. 1 having a first non-deformed deformation element.
Figure 3:
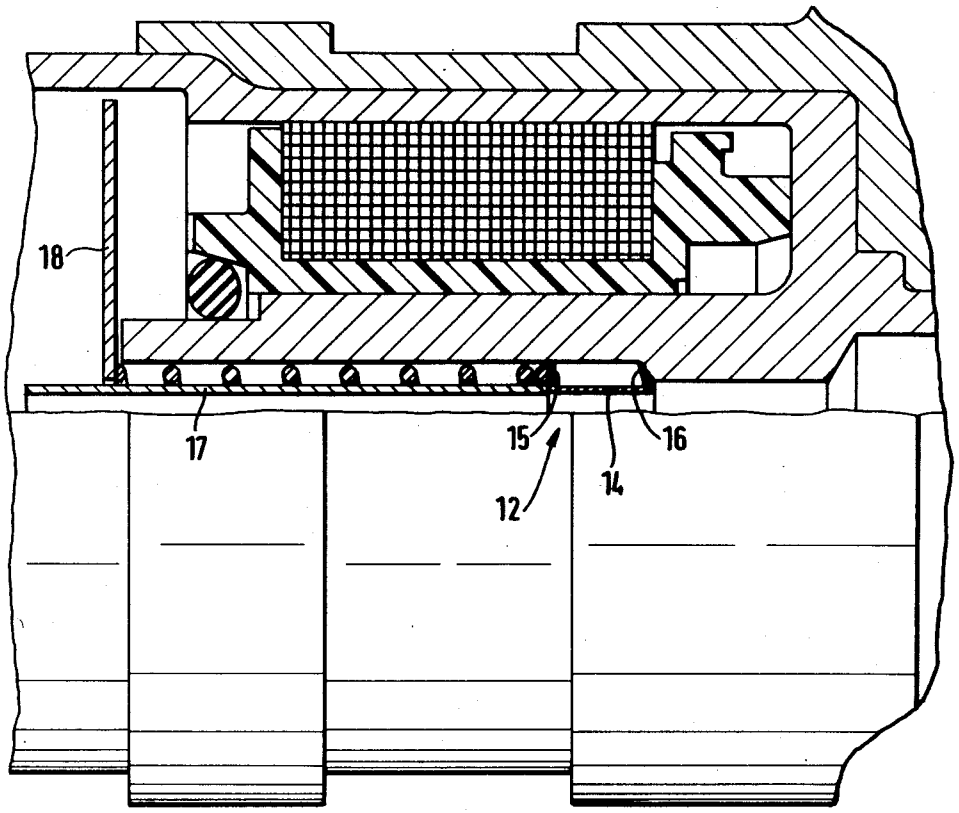
FIG. 3 shows a portion of FIG. 2 with deformed deformation element.

The buttress element 12 shown in FIGS. 1 to 3 is a sleeve 14 which has at one end a radially outwardly directed circumferential support flange 15 against which the compression spring 10 rests.

At its other end, the sleeve 14 has a circumferential deformation flange 16 which is also directed outwards. This deformation flange 16 has an outside diameter which corresponds approximately to the diameter of the larger step of the passage bore 5.

Due to the fact that the annular shoulder 11 is developed inclined from the large step towards the small step, the deformation flange 16 rests against the annular shoulder 11 only via its radially outer region. The radially inner region of the deformation flange 16 is, however, freely movable axially. In this way, the sleeve 14 can be displaced axially from its straight radial shape—such as shown in FIG. 2—into an inclined shape—such as shown in FIG. 3—by axial action of pressure on the sleeve 14 by means of a deformation tube 17, whereby plastic deformation of the deformation flange 16 effected.

By this displacement, the buttress flange 16 is pushed towards the smaller step of the passage bore 5, the relatively high initial stress of the compression spring 10 being reduced to the desired pretensioning force.

This pretensioning force can be measured on a pressure measurement plate 18 during the deformation process so that the pressure action and deformation by the deformation tube 17 is terminated at the instant when the desired pretensioning force of the compression spring 10 is reached. The annular pressure plate 18 rests against the end of the compression spring 10 which faces away from the support element 12.

Figure 4:
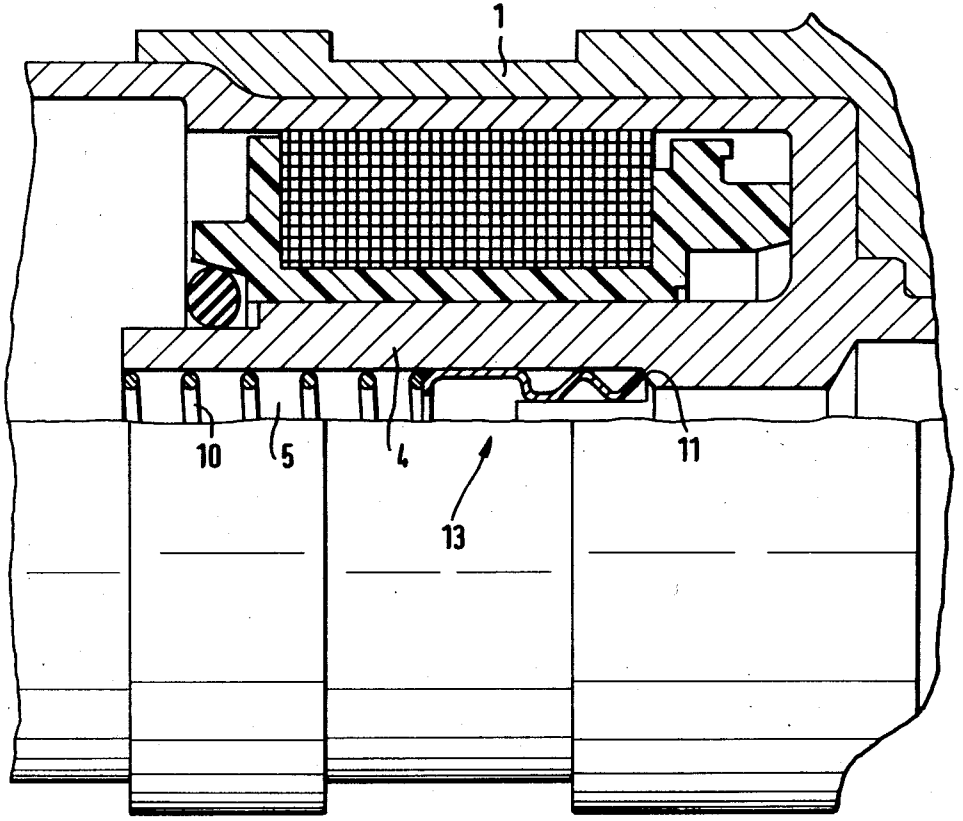
FIG. 4 shows a portion of the valve of FIG. 1 with a second deformation element.
Figure 5:
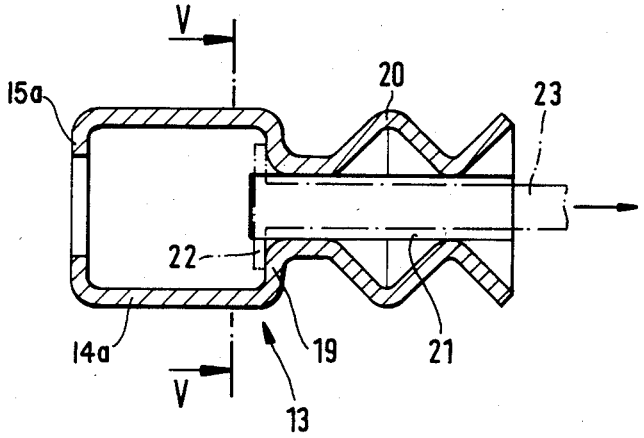
FIG 5 shows the deformation element of FIG. 1 in longitudinal section.
Figure 6:
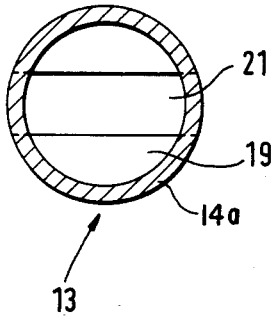
FIG. 6 shows the deformation element of FIG. 5 in section along the line V—V.

The buttress element 13 shown in FIGS. 4 to 6 also has a sleeve **14*a* which has a radially inwardly directed buttress flange 15*a* against which the compression spring 10** rests.

At its end facing away from the buttress flange **15*a* the sleeve 14*a* has a radially inwardly directed force impact flange 19 which extends at its radially inner region into a deformation bellows 20 which is directed coaxially away from the sleeve 14*a*. The free end of the deformation bellows 20 rests against the annular shoulder 11**.

Starting from the free end, a transverse slot 21 extends axially up into the region of the sleeve **14*a*. In this way, a T-shaped part 23, shown in dash-dot line, whose cross member 22 is of greater length than the inner diameter of the deformation bellows 20 can be introduced from the inlet 6 through the passage bore 5 up into the region of the sleeve 14*a*. By turning by 90°, the cross member 22 then engages behind the force impact flange 19, so that by pulling the T-shaped part 23 outward, the deformation bellows 20 is compressed axially to such an extent that the initial tension of the compression spring 10** is reduced to the desired value.

In the embodiment of FIGS. 4 to 6 this is effected preferably on the completely assembled fuel-injection valve by measuring the dynamic flow.

The resistance to deformation of the buttress elements 12 and 13 is definitely greater than the pretensioning force of the compression spring 10 so that no deformation by the compression spring 10 is possible.

The development of the fuel-injection valve in accordance with the invention makes it possible for the compression spring 10 and the annular shoulder 11 to be manufactured with only relatively little precision since these inaccuracies are again counteracted by the deformation of the buttress elements 12 and 13.

I claim:

1. In an electromagnetically actuatable fuel-injection valve for injection systems of internal combustion engines, having a valve housing, a soft-iron core arranged within the valve housing carries a stationary magnet winding, and an armature coaxial to and facing said core forming an air gap therewith, the armature being connected to or forming a valve closure member, the core being formed with a passage bore leading from an inlet to the valve closure member, a compression spring arranged within said bore and having one end buttressed, the other end of said spring resting with a given initial stress against said armature, the improvement comprising an axially plastically deformable support element in said passage bore, said compression spring being buttressed by said support element, said support element has a resistance to deformation greater than the force of said given initial tension of the compression spring.

2. The fuel-injection valve according to claim 1, wherein said passage bore is a stepped bore having a transition from a step of larger diameter facing the valve closure member to a step of smaller diameter, said transition forms an annular shoulder, said support element is buttressed against said annular shoulder.

3. The fuel-injection valve according to claim 1, wherein said support element is a sleeve.

4. The fuel-injection valve according to claim 3, wherein said sleeve has a deformation element which is buttressed in said passage bore.

5. The fuel-injection valve according to claim 4, wherein said deformation element is formed by a circumferential deformation flange which projects radially at one end of said sleeve.

6. The fuel-injection valve according to claim 5, wherein said flange forms a radially outer free end and a radially inner region of the deformation element, said radially outer free end is buttressed in the passage bore, while said radially inner region is freely axially movable.

7. The fuel-injection valve according to claim 14, wherein said sleeve has a cylindrical wall and is adapted to be acted on in an end region of said cylindrical wall by a deformation force.

8. The fuel-injection valve according to claim 4, wherein said deformation element comprises a deformation bellows at one end of said sleeve coaxially to said sleeve.

9. The fuel-injection valve according to claim 8, further comprising a force impact flange comprising a transition extending from said sleeve to said deformation bellows adapted to be acted on by a deformation force.

10. The fuel-injection valve according to claim 8, wherein said deformation bellows is formed with an axially directed transverse slot, starting from a region of the sleeve and extending to an end of the deformation bellows which is opposite the sleeve.

11. The fuel-injection valve according to claim 4, wherein said sleeve has at an end thereof opposite said deformation element, a radially circumferential buttress flange, said compression spring is buttressed against said buttress flange.

12. A method of adjusting application force of a compression spring in an electromagnetically actuatable fuel-injection valve for injection systems of internal combustion engines, having a valve housing, a soft-iron core arranged within the valve housing carrying a stationary magnet winding, and an armature coaxial to and facing said core forming an air gap therewith, the armature being connected to or forming a valve closure member, the core being formed with a passage bore leading from an inlet to the valve closure member, a compression spring arranged within said bore and having one end buttressed, the other end of said spring resting with a given initial stress against said armature, comprising the steps of providing an axially plastically deformable support element in said passage bore, buttressing said compression spring by said support element, providing said support element with a resistance to deformation greater than the force of said given initial tension of the compression spring, and adjusting the application force of the compression spring by axially plastically deforming said support element.

13. The method of adjusting application force of a compression spring according to claim 12, further comprising measuring the application force of the compression spring while adjusting the application force of the compression spring.

14. The method of adjusting application force of a compression spring according to claim 12, wherein the application force of the compression spring is performed on a completely assembled said fuel-injection valve under operating conditions.

* * * * *